US006580039B2

(12) United States Patent
Nakade et al.

(10) Patent No.: US 6,580,039 B2
(45) Date of Patent: Jun. 17, 2003

(54) MULTIDIRECTIONAL SWITCH AND OPERATION UNIT USING THE SAME

(75) Inventors: Yoshiyuki Nakade, Fukui (JP); Shigeyoshi Umezawa, Fukui (JP); Naoaki Matsui, Fukui (JP); Hitokazu Shitanaka, Fukui (JP)

(73) Assignee: Matsushita Electric Industrial, Osaka (JP)

( * ) Notice: Subject to any disclaimer, the term of this patent is extended or adjusted under 35 U.S.C. 154(b) by 23 days.

(21) Appl. No.: 09/804,228

(22) Filed: Mar. 13, 2001

(65) Prior Publication Data

US 2001/0027912 A1 Oct. 11, 2001

(30) Foreign Application Priority Data

Mar. 15, 2000 (JP) ..... 2000-071814

(51) Int. Cl.[7] ..... H01H 21/84
(52) U.S. Cl. ..... 200/6 A; 200/18; 200/561
(58) Field of Search ..... 200/553, 561, 200/339, 6 A, 5 R, 18, 517

(56) References Cited

U.S. PATENT DOCUMENTS 4,511,769 A * 4/1985 Sahakian et al. ..... 200/553 X
4,975,547 A * 12/1990 Nakayama et al. ..... 200/5 R
4,992,631 A * 2/1991 Gee ..... 200/339
5,468,924 A * 11/1995 Naitou et al. ..... 200/6 A
5,655,650 A * 8/1997 Naitou ..... 200/339
5,691,517 A 11/1997 Yamamoto et al. ..... 200/6 A
5,813,519 A * 9/1998 Gotoh ..... 200/5 R X
5,887,704 A 3/1999 Schorpp et al.
6,096,985 A * 8/2000 Ritter et al. ..... 200/6 A

* cited by examiner

*Primary Examiner*—Renee Luebke
(74) *Attorney, Agent, or Firm*—Wenderoth, Lind & Ponack, L.L.P.

(57) ABSTRACT

Disclosed is a multidirectional switch and an operation unit containing the switch, to be used for controlling an automobile air-conditioner, for example. Respective operating areas of an operation body are positioned at a middle area between push button switches. Therefore, a pressing force applied to an operating area causes a swaying motion of a swaying body, and push structure of the swaying body push two switching contacts at substantially the same time, resulting in electrical connection/disconnection. The configuration of the multidirectional switch eliminates such constituent components as a coil spring, supporting pin, and the like, yet it provides an inexpensive multidirectional switch that has a superior operational feeling with a smaller number of constituent components.

28 Claims, 13 Drawing Sheets

MULTIDIRECTIONAL SWITCH AND OPERATION UNIT USING THE SAME

FIELD OF THE INVENTION

The present invention relates to a multidirectional switch and an operation unit containing the switch, wherein a suitable application sector of the operation unit includes a control unit for an automobile air-conditioner or the like.

BACKGROUND OF THE INVENTION

A conventional operation unit for controlling an air-conditioner of an automobile has a panel as shown in FIG. 10; where a number of push button switches 1 corresponding to respective functions are disposed within a frame 3, together with LED displays or the like indicating the functions. Lately, automobiles have been equipped with varieties of additional functions; and a so-called multidirectional switch, which is capable of handling varieties of instructions in a single-body switch, has been increasingly used in the operation units, instead of using a plurality of single-function push button switches 1.

Such a multidirectional switch of a conventional structure is described in the following with reference to FIG. 11 through FIG. 13.

FIG. 11 is a cross sectional side view of a conventional multidirectional switch, and FIG. 12 shows an exploded perspective view of the multidirectional switch.

As shown in FIG. 11 and FIG. 12, a cylindrical case 5 made of an insulating resin is provided with a boss 5A protruding upwardly from a center of a bottom surface of the case, and two protrusions 5B in the vicinity of the boss 5A.

A hole 5C in the boss 5A houses a supporting pin 7, which is pushed upwardly by a slightly compressed coil spring 6. An upper end of the supporting pin 7 has a spherical surface.

A wiring board 8 having a plurality of conductive patterns (not shown) on both of its surfaces is provided with five push button switches 9A–9E on its upper surface, which are disposed in a radial arrangement around a central through hole 8A and fixed thereon by soldering or the like, and perform electrical connection/disconnection in accordance with a pressing operating force accompanying a click feeling.

The wiring board 8 is fixed with two screw bolts 10 onto the protrusions 5B of case 5, with the through hole 8A penetrated by the boss 5A of case 5.

The wiring board 8 is coupled with lead wires 11 at one end by soldering, or by using a conductive adhesive, and the lead wires 11 are connected via a conductive pattern with respective push button switches 9A–9E.

The lead wires 11 extend from the case 5 through an opening 5D, to be electrically connected at another end with an electronic circuit (not shown) of an automobile.

A swaying body 12 made of an insulating resin is provided just above the wiring board 8. The swaying body 12 is provided with an operating axle 12B protruding upwardly from a center of an upper surface of a bowl part 12A.

Provided at a center of a lower surface of the bowl part 12A is a clicking void 12C, which has an elastic contact with the supporting pin 7 at the upper end thereof. The bowl part 12A is provided with five push sections 12D–12H extending in a radial arrangement from an outer circumference of the bowl part. Tip ends of the push sections make contact at their bottom surfaces with upper surfaces of the push button switches 9A–9E.

A cover 13 covering the case 5 from above is provided on its upper surface with varieties of markings, painted by a printing process or a similar method. An opening 13A is provided at a center of the cover 13, and a contact portion 13B of a spherical shape is provided at a lower part of the opening 13A.

The swaying body 12, which is pushed upwardly by the supporting pin 7, makes contact at the upper surface of the bowl part 12A with the contact portion 13B. Thus, the swaying body 12 is supported by the supporting pin 7 at its upper end, so that the swinging body can sway around the upper end of the supporting pin.

An operation body 14 has an operating area 14A of a flange shape at an upper surface of the operation body, and a coupling section 14B protruding downwardly from a center of a lower surface of the operation body. The coupling section 14B is inserted through the opening 13A of cover 13 to be coupled and fixed with the operating axle 12B of the swaying body 12. A conventional multidirectional switch is thus constituted.

In the above-configured multidirectional switch, when the operation body 14 is pressed in a certain specific direction, for example, when the operating area 14A is pressed downwardly at the left end the swaying body 12 sways to the left with the upper end of the supporting pin 7 serving a fulcrum point so that the bottom end surface of the push section 12D pushes the push-button switch 9A downwardly. Then, the push-button switch 9A is brought into an electrical connection.

At this time, as a result of swaying of the swaying body 12, the push sections 12E and 12H located next to the push section 12D also move slightly downwardly to press the push-button switches 9B and 9E located next to the push-button switch 9A. Since the loads of pressing the push-button switches 9B and 9E are added to that of pressing the push-button switch 9A, a click feeling of the push-button switch 9A itself is deteriorated.

However, as a result of the swaying motion of swaying body 12, the point of making contact between the upper end of the supporting pin 7 and the clicking void 12C shifts, which results in a change in the amount of flexion with the coil spring 6. This generates a click feeling corresponding to the amount of load drop P1 as exhibited in FIG. 13, which is an operational characteristics diagram.

In the conventional multidirectional switches of the above-described configuration, the coil spring 6 and the supporting pin 7 are the essential components for generating the click feeling; which means an increased number of constituent components. Furthermore, the click feeling of the push-button switch 9A itself, which makes electrical connection/disconnection in accordance with a pressing operation, is deteriorated, resulting in a reduced amount of the load drop P1. Thus, it has been difficult to provide a satisfactory operational feeling with the conventional multidirectional switches.

SUMMARY OF THE INVENTION

A multidirectional switch of the present invention has an operation body comprising a plurality of operating areas, each of which is positioned at a middle area between contact switches. A pressing force applied to the operation body sways a swaying body, bringing two contact switches into electrical connection/disconnection at substantially the same time. With the above-described structure, where push structure of the swaying body press two contact switches at substantially the same time, a superior feeling of operation is generated without requiring such constituent components as a coil spring, supporting pin or the like. Thus, the present invention provides an inexpensive multidirectional switch that is formed of fewer components, and provides a superior feeling of operation.

DESCRIPTION OF THE PREFERRED EMBODIMENTS

Referring to FIG. 1 through FIG. 9, exemplary embodiments of the present invention are described in the following.

Those constituent portions identical to those of the conventional multidirectional switch described earlier in BACKGROUND OF THE INVENTION are represented by the same symbols, and detailed descriptions thereof are omitted.

First Embodiment

Figure 1:
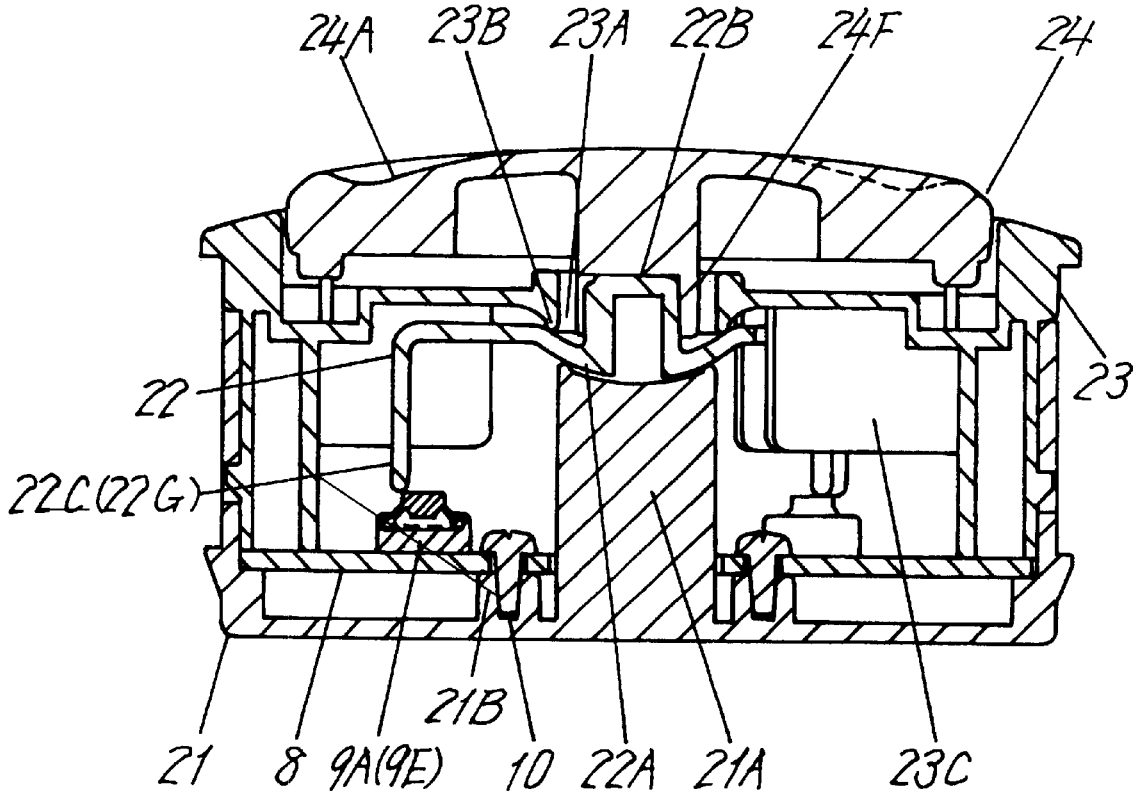
FIG. 1 is a cross sectional side view of a multidirectional switch in accordance with a first exemplary embodiment of the present invention.
Figure 2:
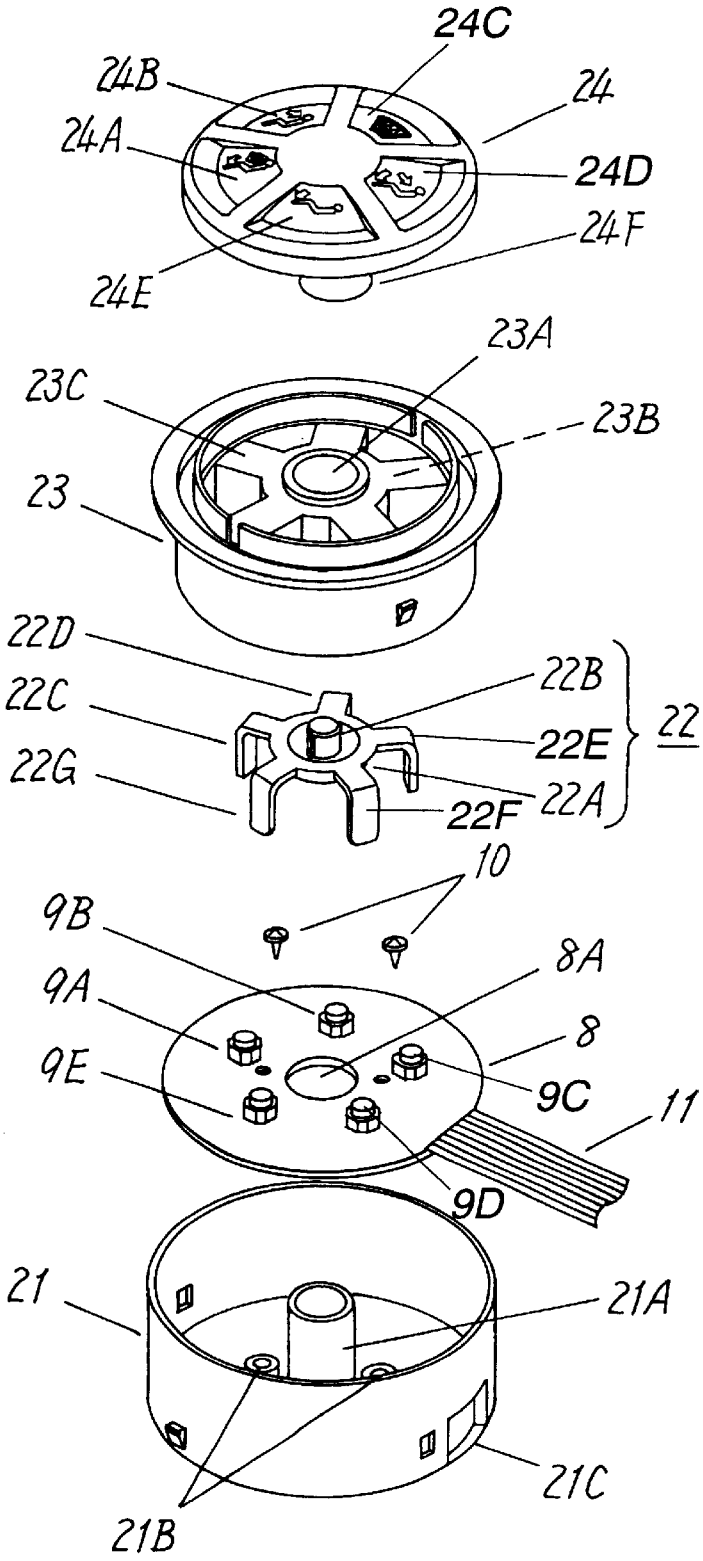
FIG. 2 shows an exploded perspective view of the multidirectional switch of FIG 1.

As shown in FIGS. 1 and 2, a cylindrical case 21 made of an insulating resin is provided with a support 21A protruding upwardly from a center of a bottom of the case. A the top end of support 21A has a recessed surface, and two protrusions 21B are disposed in the vicinity of the support 21A.

A wiring board a having a plurality of conductive patterns (not shown) on both surfaces is provided on its upper surface with five push button switches 9A–9E disposed in a radial arrangement around a central through hole 8A and, fixed thereon by soldering or the like. The push button switches perform, as a result of a pressing operation, electrical connection/disconnection accompanying a click feeling.

The wiring board 8 is fixed with two screw bolts 10 onto the protrusions 21B of case 21, with the through hole 8A receiving the support 21A of case 21.

The wiring board 8 is coupled with lead wires 11 at one end by soldering, or by using a conductive adhesive, and the lead wires 11 are connected via a conductive pattern with respective push button switches 9A–9E. The lead wires 11 extend out of the case 21 through an opening 21C, to be electrically connected at another end with an electronic circuit (not shown) of an automobile.

A swaying body 22 made of an insulating resin is provided just above the wiring board 8, in a manner that a bowl portion 22A at a center of a lower surface of the swaying body is held on the support 21A of case 21 so that the swaying body can sway. The swaying body 22 is provided with an operating axle 22B protruding upwardly from a center of an upper surface of the bowl portion 22A.

Extending in a radial arrangement from an outer circumference of bowl portion 22A are five push sections 22C–22G, a tip end of which makes contact with an upper surface of the push button switches 9A–9E.

The case 21 is covered from above with a cover 23, which is provided with an opening 23A at its center, and surrounding the opening 23A is a contact portion 23B. The upper surface of the bowl portion 22A of the swaying body 22 makes contact with the contact portion 23B. The push sections 22C–22G are housed in and supported respectively by five guide portions 23C go that the swaying body 22 does not revolve.

Figure 3:
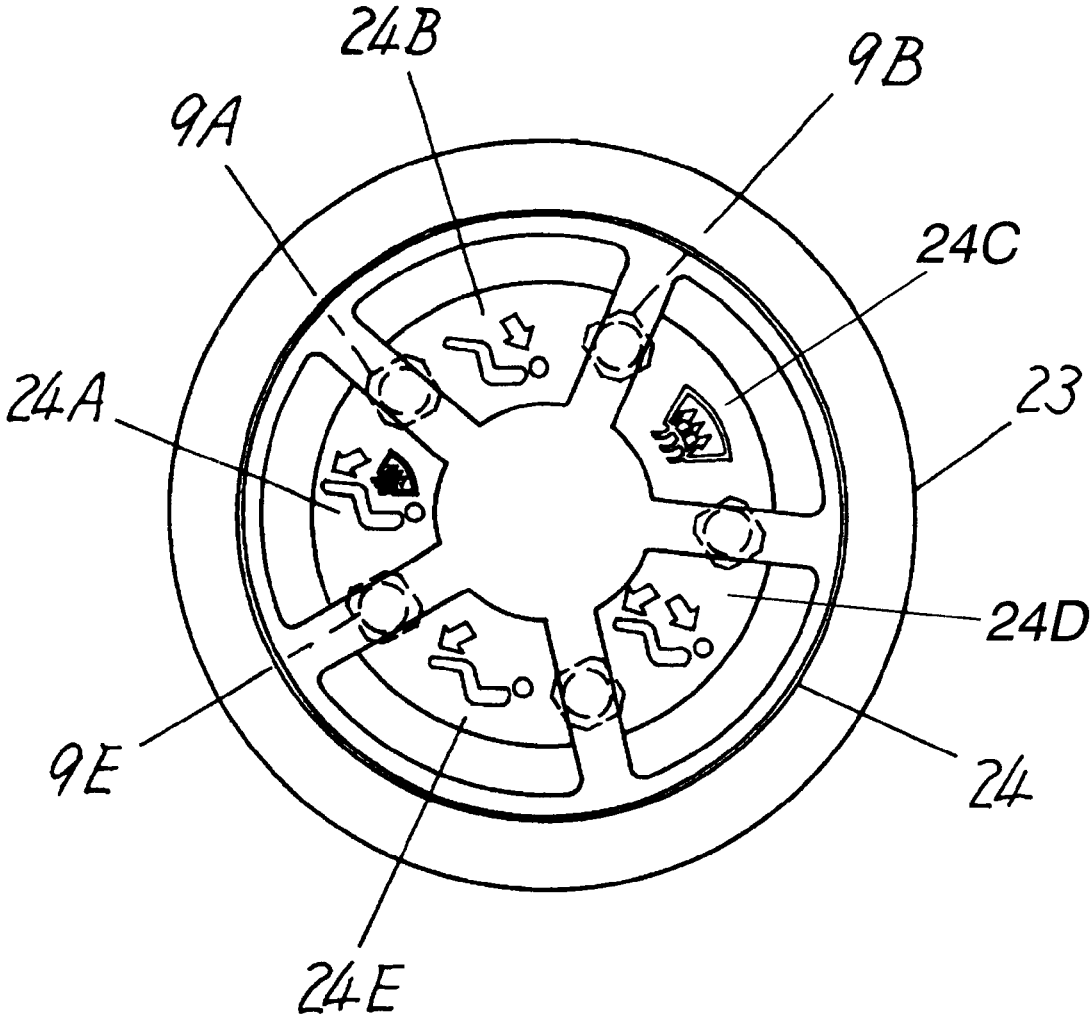
FIG. 3 is a plan view of the multidirectional switch of FIG. 1.

An operation body 24, which has five slightly recessed operating areas 24A–24E on an upper surface of the operation body, is disposed so that each of the respective operating areas 24A–24E is positioned in a middle region between the push button switches 9A–9E, as shown in FIG. 3. Upper surfaces of the operating areas 24A–24E are provided with various markings provided by a printing process or the like.

A coupling section 24F protruding from a center of a lower surface of the operation body 24 is inserted through the opening 23A of cover 23 to be coupled with the operating axle 22B of the swaying body 22, in a manner such that they do not revolve relative to each other. A multidirectional switch of the present invention is thus constituted.

Figure 4:
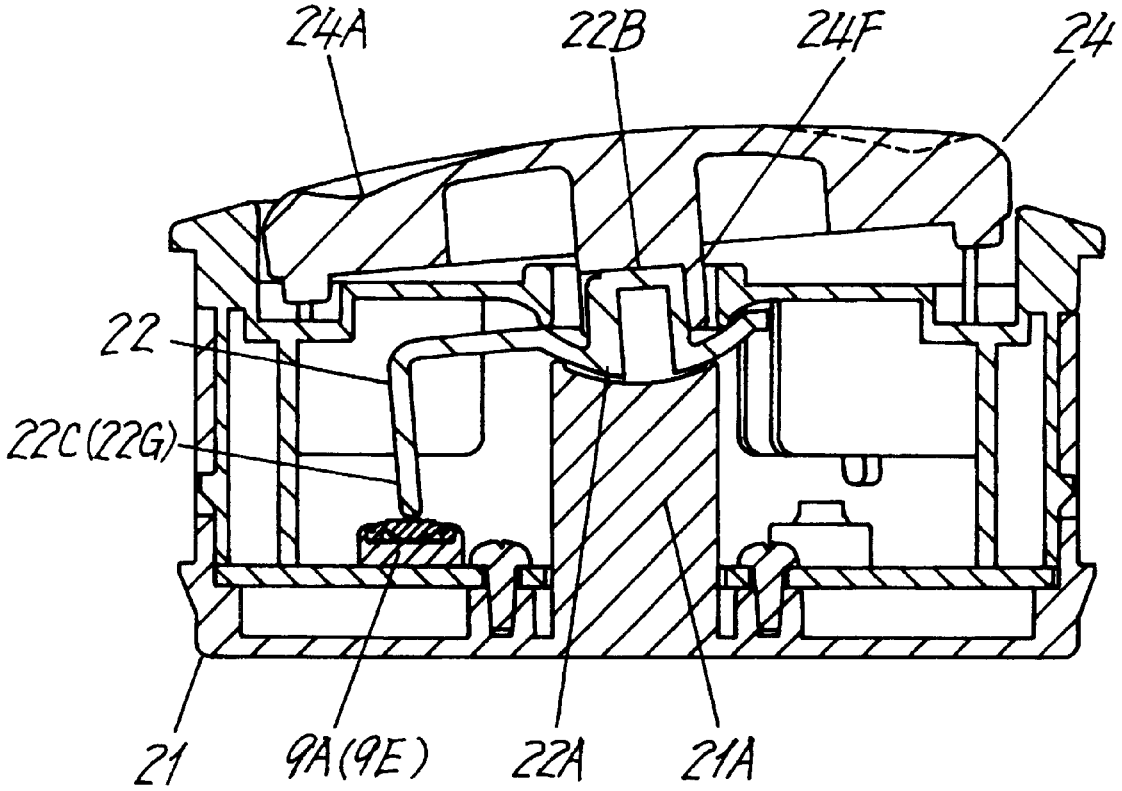
FIG. 4 is a cross sectional side view of the multidirectional switch of FIG. 1 during operation.

Under the above-described configuration, when the operation body 24 is pressed to a certain specific direction; for example, when the operating area 24A located at the left end is pressed downwardly the swaying body 22, which is coupled to the operating axle 22B by the coupling section 24F of the operation body 24, sways to the left, as shown in FIG. 4, around the bowl section 22A which functions as a fulcrum. The push sections 22C and 22G located respectively at a middle region between the operating areas push, via their tip ends, the push button switches 9A and 9E at substantially the same time, bringing the push button switches into electrical connection/disconnection.

Figure 5:
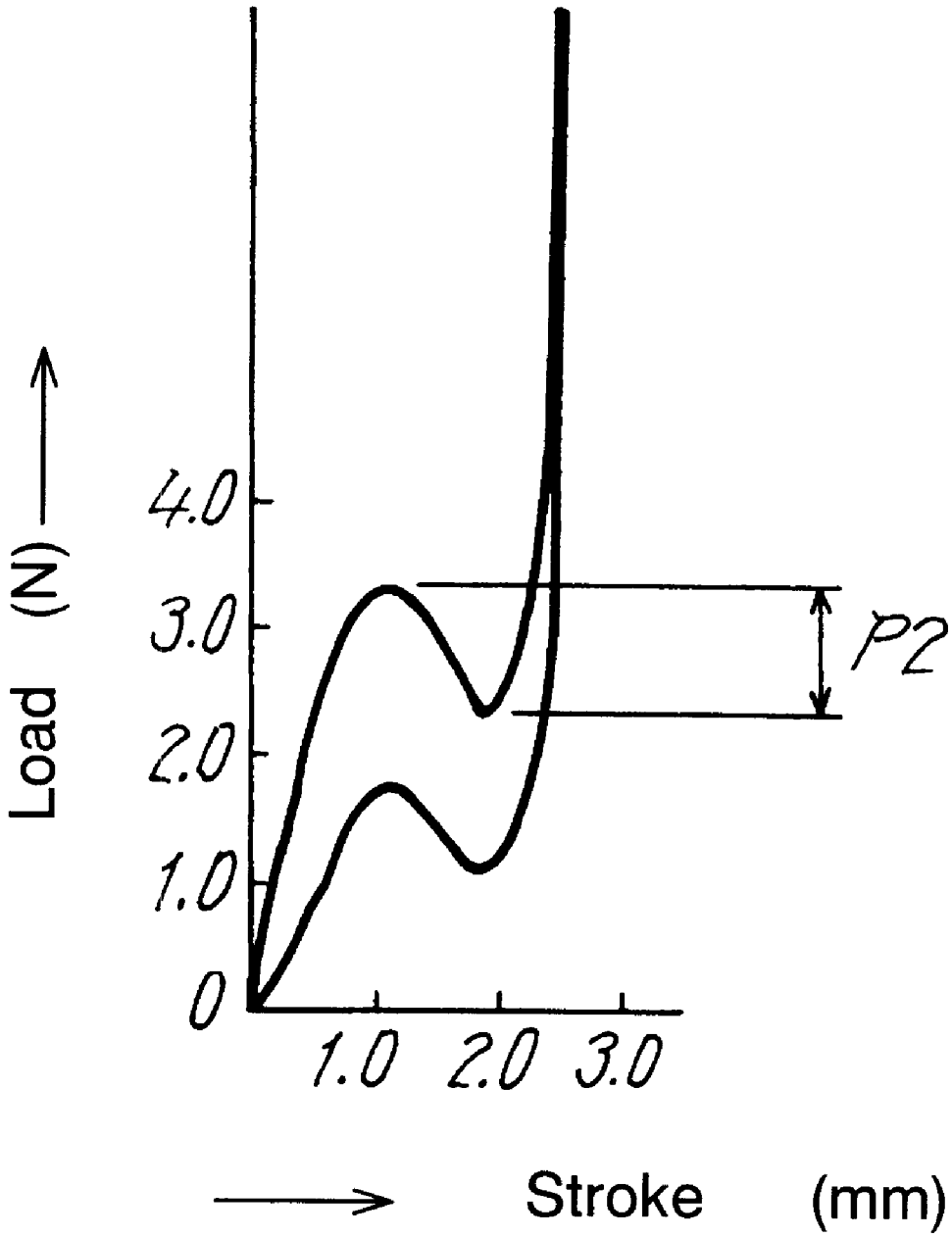
FIG. 5 shows operational characteristics of the multidirectional switch of FIG. 1.

At this moment, an operator perceives through the operation body 24 a substantial click feeling of operation that corresponds to the considerable amount of load drop P2 shown in FIG. 5. The substantial amount of click feeling of operation originates from the click feelings generated by the two push switches 9A and 9E. The signals of electrical connection/disconnection generated from the two push button switches 9A and 9E are transmitted to an electronic circuit of an automobile through the lead wires 11 connected with the wiring board 8.

When the operation body 24 is pressed in other directions, namely when either one of the operating areas 24B–24E is pressed downwardly, two of the push button switches from among 9A–9E are pressed at substantially the same time by the corresponding swaying body 22's push sections from among 22C–22G located at the middle regions. The electrical connection/disconnection is thus performed.

In a multidirectional switch in accordance with the present embodiment, each of the operating areas 24A–24E of the operation body 24 is located at the middle region between the plurality of push button switches 9A–9E. Operating pressure applied to one of the operating areas causes a sway of the swaying body 22, and some of the push sections from among 22C–22G bring two of the switching contacts into connection at substantially the same time. With the above-described configuration, such constituent components as a coil spring, a supporting pin or the like can be eliminated, and multidirectional switches that are inexpensive yet provide a superior feeling of operation are provided.

Second Embodiment

A second exemplary embodiment of the present invention is described below. Those portions having the same structure as in the first embodiment are indicated by the same symbols.

Figure 6:
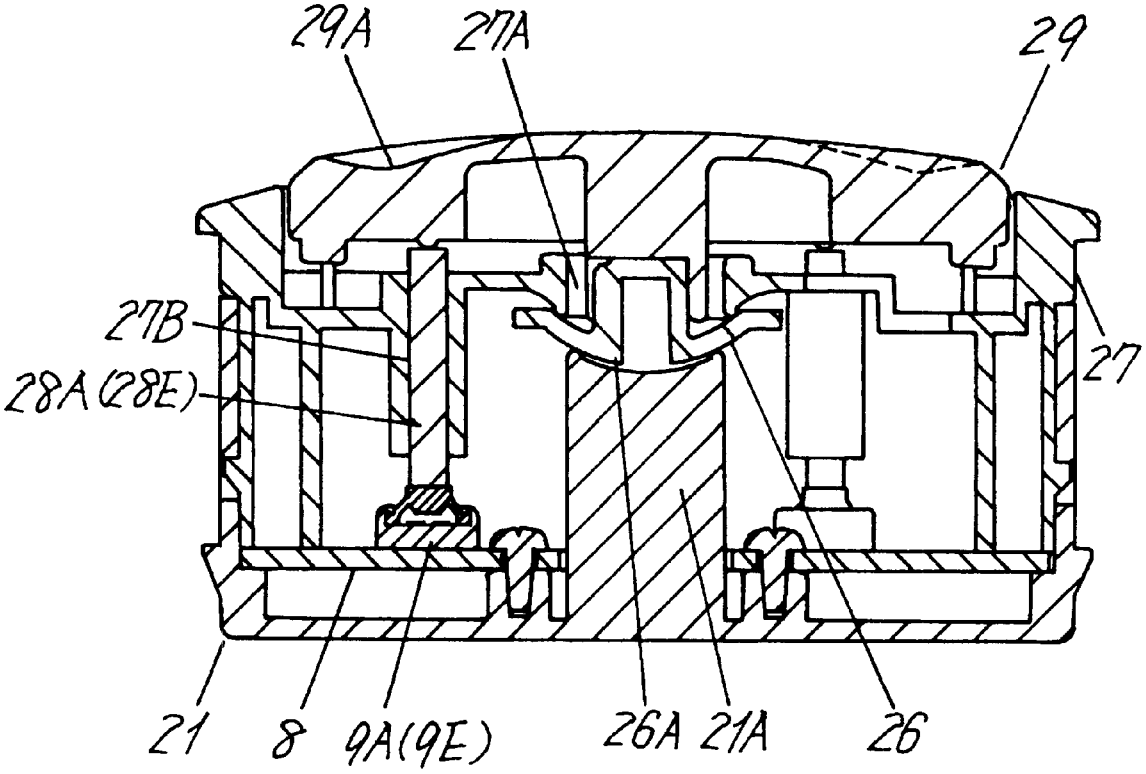
FIG. 6 is a cross sectional side view of a multidirectional switch in accordance with a second exemplary embodiment of the present invention.
Figure 7:
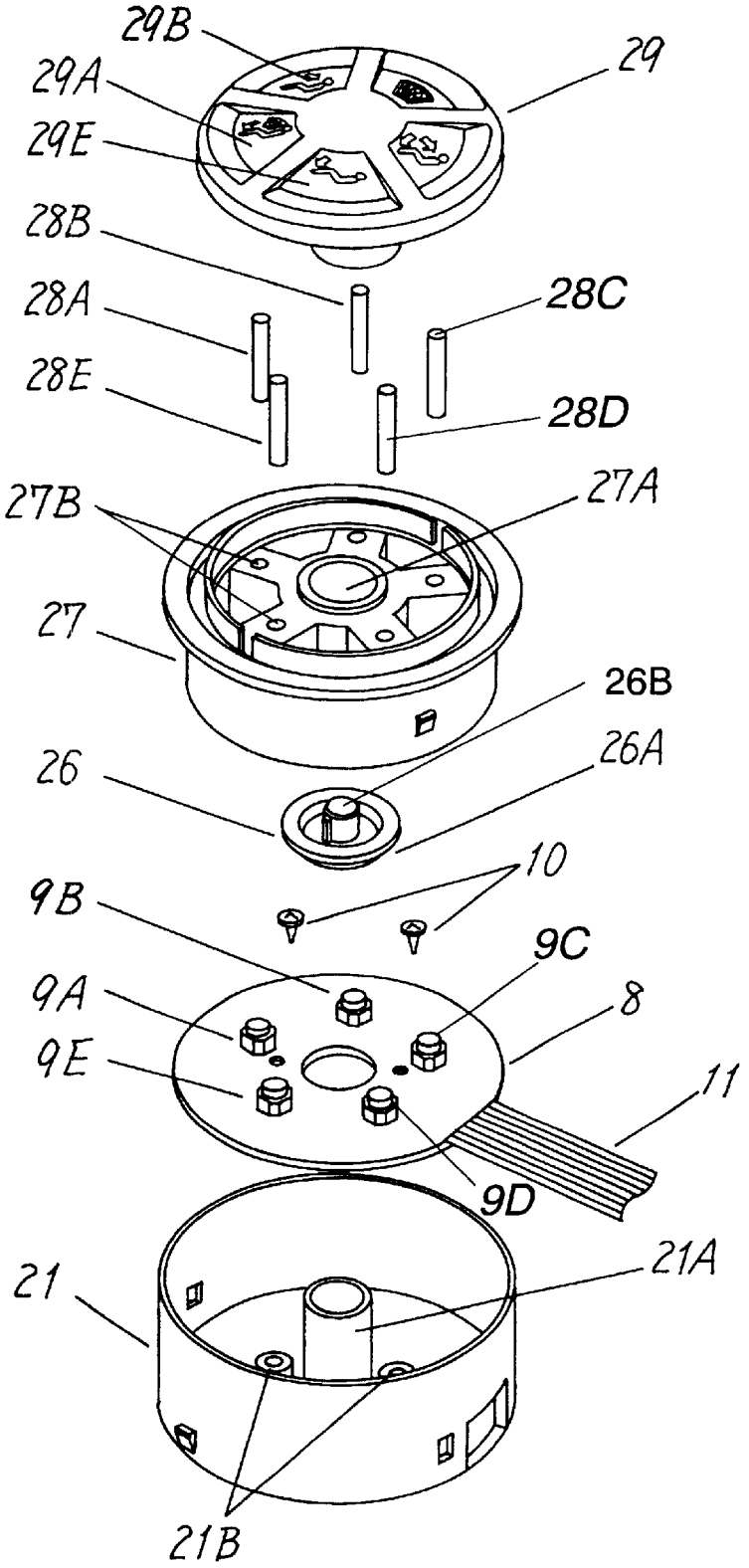
FIG. 7 shows an exploded perspective view of the multidirectional switch of FIG. 6.

Referring to FIGS. 6 and 7, as in the same manner with the first embodiment, a cylindrical case 21 is provided with a support 21A, which protrudes from a center of a bottom of the case, and the upper end of which has a recessed surface. And a wiring board 8 having five push button switches 9A–9E disposed on its upper surface in a radial arrangement is also fixed to the case 21.

Also in the same way as in the first embodiment, a swaying body 26 having an operating axle 26B at a center of an upper surface of the swaying body is placed in the case 21 so that the swaying body can make a swaying motion via a bowl portion 26A of the swaying body 26. The bowl portion 26A is at a center of a lower surface of the swaying body, and is supported on the support 21A of case 21. However, in the present embodiment, the swaying body 26 is not provided with a push section. Instead, a cover 27 is provided with five through holes 27B disposed in a radial arrangement around an opening 27A located at a center of the cover. Five column-shaped push members 28A–28E are inserted into the respective through holes 27B so that these push members can slide up and down in the through holes with bottom ends of the push members making contact with upper surfaces of the push button switches 9A–9E.

The column-shaped push members 28A–28E make contact at their upper ends with a lower surface of an operation body 29 at middle regions between five respective operating areas 29A–29E. These push members move up and down in accordance with pressure provided by the operation body 29. A multidirectional switch in a second embodiment is thus formed.

Under the above-described configuration, when the operation body 29 is pressed to a certain specific direction; for example, when the operating area 29A locating at the left end is pressed downwardly, the push member 28A, whose upper end is being pressed by the lower surface of the operation body at the middle region between the operating areas 29A and 29B, and the push member 28E, whose upper end is being pressed by the lower surface of the operation body at the middle region between the operating areas 29A and 29E, move downwardly within the through holes 27B. The lower ends of the respective push members 28A and 28E push the push button switches 9A and 9E at substantially the same time, thereby bringing the push button switches into electrical connection/disconnection.

At this moment, an operator perceives a superior feeling of operation that originates from the click feelings of the respective two push button switches 9A and 9E. The signals of electrical connection/disconnection generated from the two push button switches 9A, 9E are transmitted to an electronic circuit of an automobile through the lead wires 11, which have been connected with the wiring board 8.

When the operation body 29 is pressed in other directions, two of the push button switches from among 9A–9E are pressed at substantially the same time. Thus, the electrical connection/disconnection is performed in the same manner as in the first embodiment.

As described above, a multidirectional switch of the present embodiment is provided with push members 28A–28E that move up and down when their upper ends are pressed by the operation body 29 at its lower surface. In a structure where a plurality of switch contacts are brought into electrical connection/disconnection by a straight-line motion of push members, a more reliable operation in a switching contact can be expected. In addition, such structure provides a clearer operational feeling of clicking.

Figure 8:
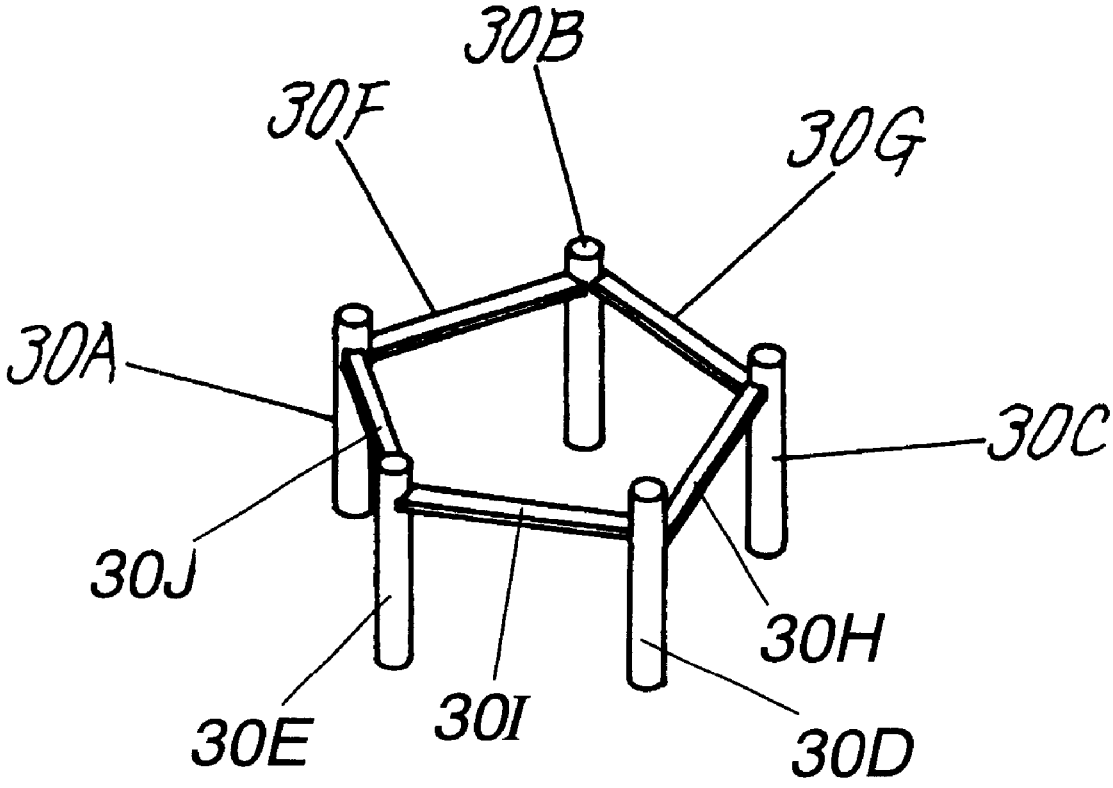
FIG. 8 shows a perspective view of a push structure of the multidirectional switch of FIG. 6.

Assembly of the multidirectional switches can be made easier, by providing a plurality of push members 30A–30E in the form of a unitized component, by virture of the push members being connected by thin and flexible arms 30F–30J into one piece, as shown in FIG. 8.

Figure 9:
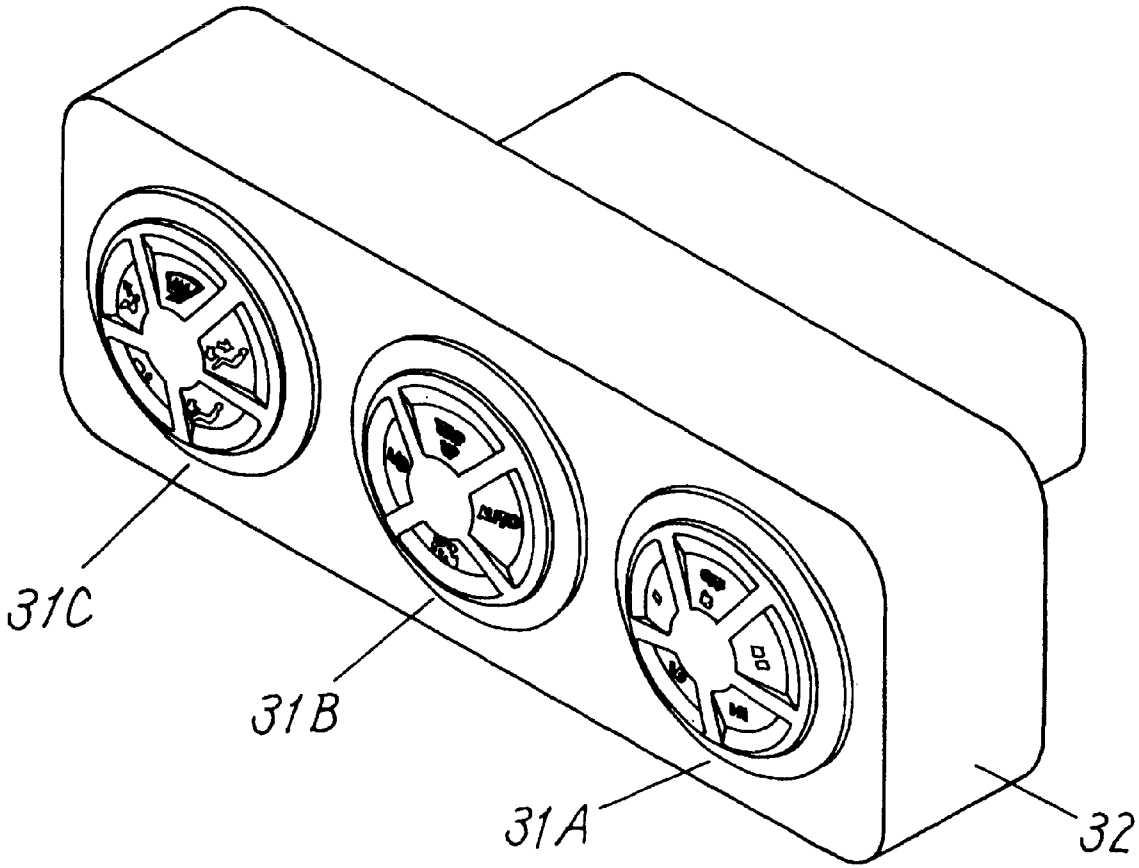
FIG. 9 shows a perspective view of an operation unit containing the multidirectional switches of either FIG. 1 or FIG. 6.
Figure 10:
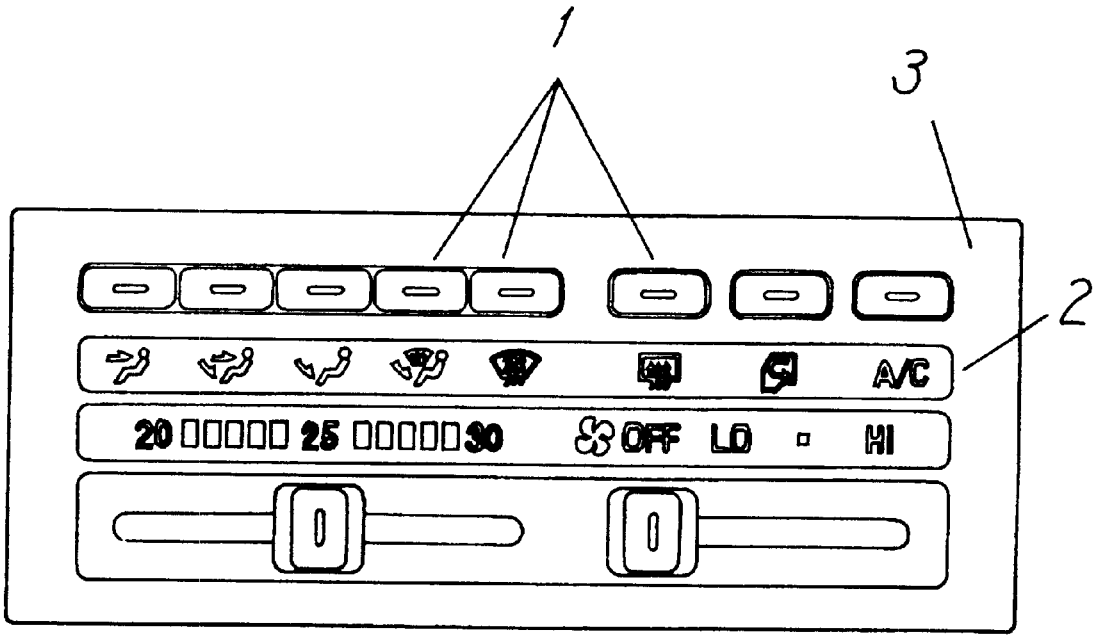
FIG. 10 Prior Art
FIG. 10 shows a front view of a conventional operation unit.
Figure 11:
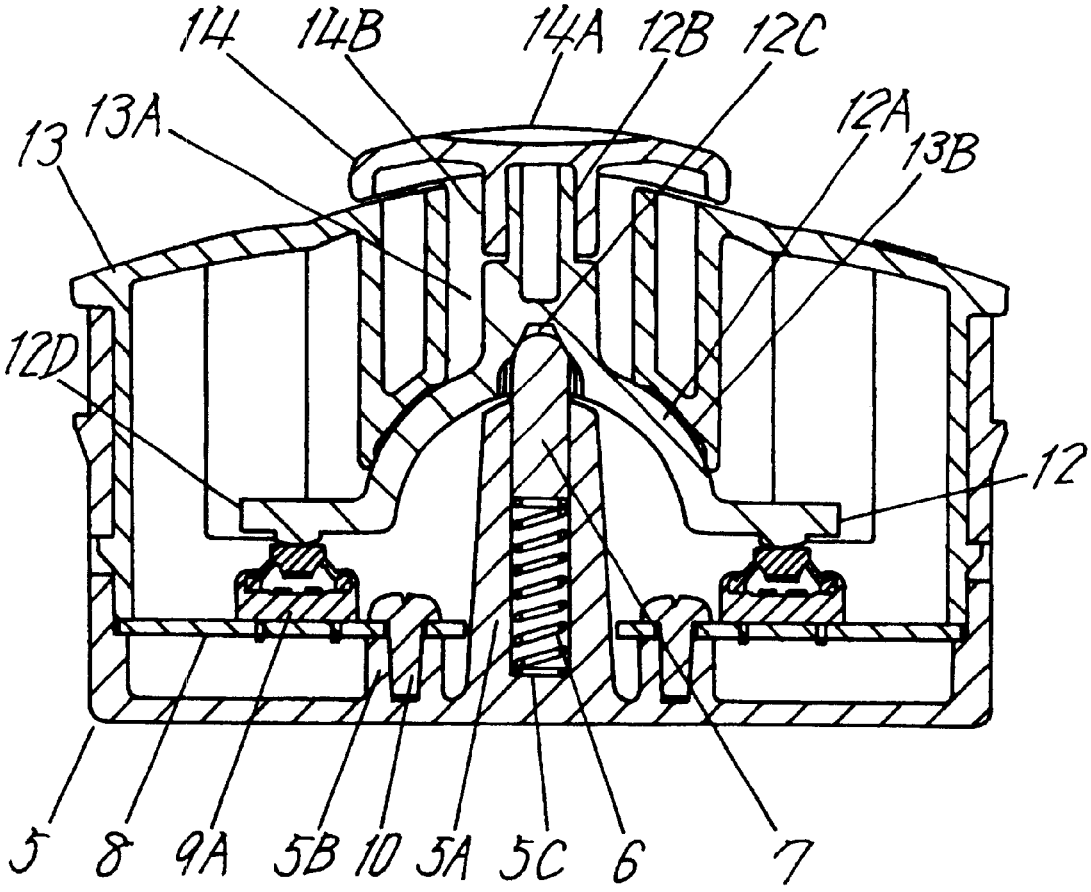
FIG. 11 Prior Art
FIG. 11 is a cross sectional side view of a conventional multidirectional switch.
Figure 12:
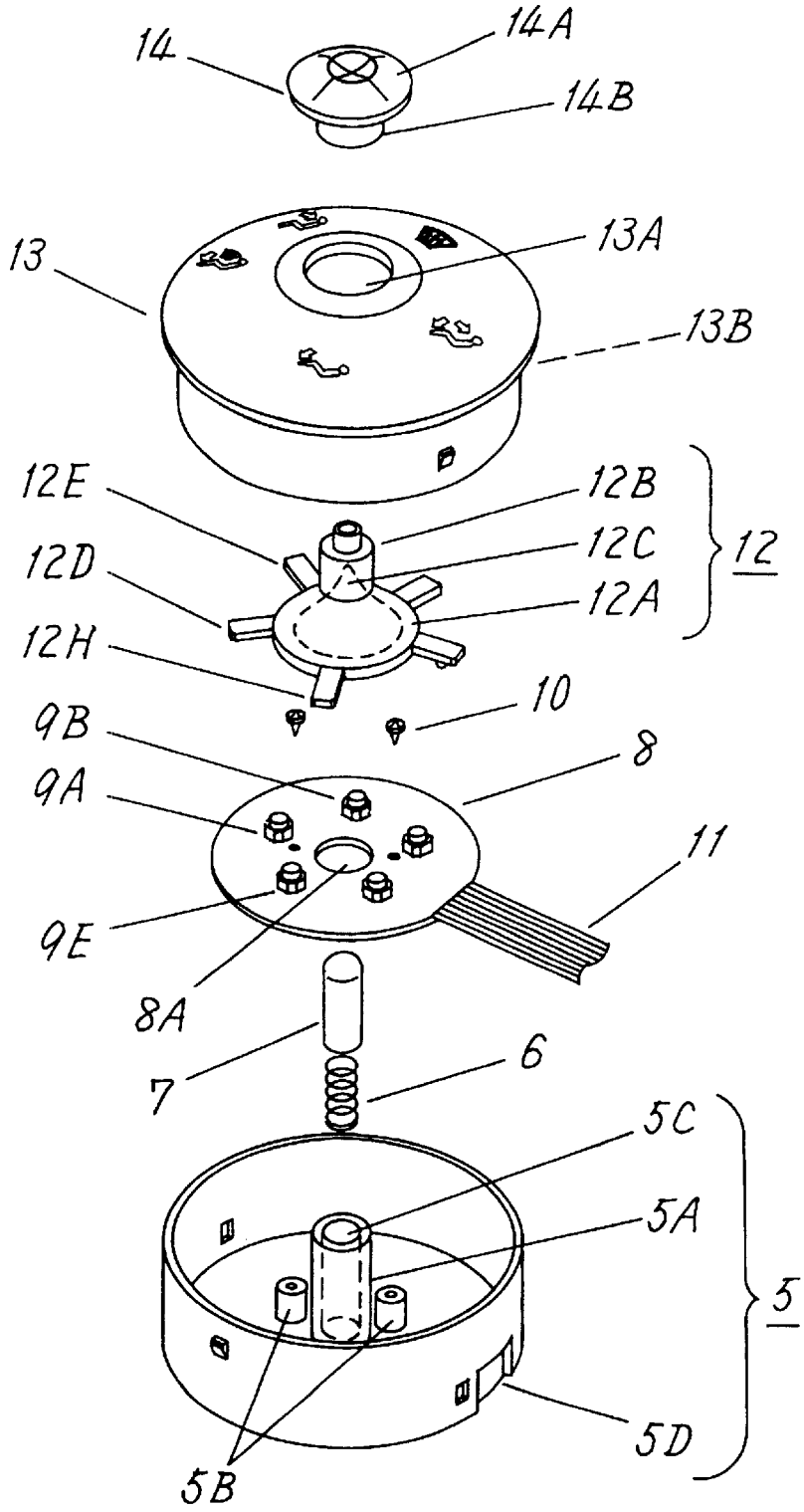
FIG. 12 Prior Art
FIG. 12 shows an exploded perspective view of the conventional multidirectional switch.
Figure 13:
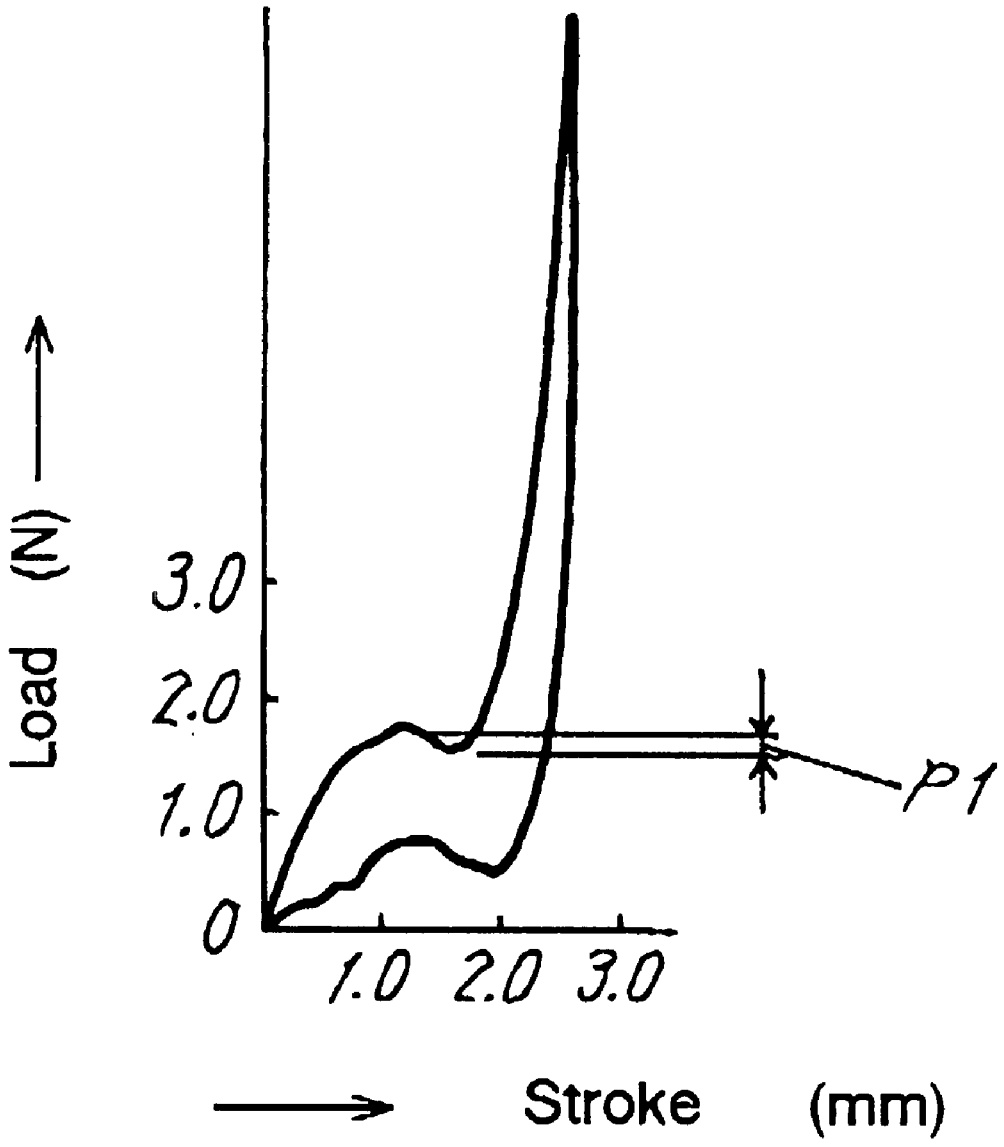
FIG. 13 Prior Art
FIG. 13 shows operational characteristics of the conventional multidirectional switch.

As shown in a perspective view of FIG. 9, a plurality of the multidirectional switches 31A, 31B and 31C, described in the above first and second embodiments, may be mounted on a framework 32 with the operation bodies of the switches facing forwardly. Where, for example, the switch 31A may be assigned, for example, to the control of the amount of air flow, switch 31B to control the temperature, and switch 31C to control the direction of air flow of a car air-conditioner. In such an arrangement, an operation unit for controlling the car air-conditioner can be fabricated compactly at a lower cost with a reduced number of constituent parts and components, yet the operation unit provides a superior feeling of operation.

In the above-described embodiments of multidirectional switches of the present invention, the wiring board 8 has been provided with independent push button switches 9A–9E, as the switching element, mounted on the upper surface thereof. However, it may be formed instead by providing fixed contact points made by printing and curing a conductive paste on the upper surface of the wiring board 8, and providing movable contacts made of metal, film or rubber, opposing the fixed contact points with a certain specific clearance therebetween. The movable contacts are of a dome-form so that they can reverse with a snapping action against a pressing force applied thereto to generate a click feeling of operation. Further, the fixed contact points may be a made of conventional materials such as silver alloys.

What is claimed is:

1. A multidirectional switch comprising:

a case having a support extending from a bottom of said case;

a sway body swayingly supported by said support, said sway body having an operating axle extending away from said support;

plural switching contacts;

push structure for contacting said plural switching contacts; and an operation body having operating areas on an upper surface of said operation body, and also having a coupling section extending from a lower surface of said operation body and coupled to said operating axle, said operating areas being equal in number to said plural switching contacts, wherein each of said operating areas is positioned at a region that is between adjacent ones of said plural switching contacts such that a pressing force applied to a corresponding one of said operating areas results in said push structure contacting said adjacent ones of said plural switching contacts simultaneously, whereby any two of said adjacent ones of said plural switching contacts come into electrical contact via a corresponding pressing force.

2. The multidirectional switch according to claim 1, wherein each of said operating areas is defined by a corresponding recessed portion on the upper surface of said operation body.

3. The multidirectional switch according to claim 1, wherein said plural switching contacts are arranged in a circular pattern defining a first diameter, and said operating areas are arranged in a circular pattern defining a second diameter, with the second diameter being generally equal to the first diameter such that said each of said operating areas is positioned circumferentially between said adjacent ones of said plural switching contacts.

4. The multidirectional switch according to claim 1, further comprising a cover covering said case, wherein said cover has plural openings and said push structure comprises plural push member received within said plural openings, respectively.

5. The multidirectional switch according to claim 4, wherein said plural push member are connected to one another via flexible arms so as to form a single body.

6. The multidirectional switch according to claim 1, wherein said coupling section is coupled to said operating axle by being rotationally fixed to said operating axle.

7. The multidirectional switch according to claim 6, wherein said sway body also has a bowl portion, with said sway body being swayingly supported by said support via said bowl portion.

8. The multidirectional switch according to claim 7, wherein said support extends from a central portion of the bottom of said case, and said operating axle extends from a central portion of an upper surface of said bowl portion.

9. The multidirectional switch according to claim 8, further comprising a cover covering said case and having a central opening, wherein said coupling section extends from a central lower surface of said operation body and passes through said central opening.

10. The multidirectional switch according to claim 9, wherein said push structure comprises plural push sections integral with said sway body and extending radially from an outer circumference of said bowl portion.

11. The multidirectional switch according to claim 9, further comprising plural push button switches on which are installed said plural switching contacts.

12. The multidirectional switch according to claim 9, wherein said plural switching contacts comprise printed and cured conductive paste.

13. The multidirectional switch according to claim 9, wherein said cover further has plural openings surrounding said central opening of said cover, and said push structure comprises plural push member received within said plural openings, respectively.

14. The multidirectional switch according to claim 13, wherein said plural push member are connected to one another via flexible arms so as to form a single body.

15. An operation unit comprising:

plural multidirectional switches; and a framework in which are mounted said plural multidirectional switches, wherein each of said plural multidirectional switches includes (i) a case having a support extending from a bottom of said case, (ii) a sway body swayingly supported by said support, said sway body having an operating axle extending away from said support, (iii) plural switching contacts, (iv) push structure for contacting said plural switching contacts, and (v) an operation body facing forwardly of said framework, said operation body having operating areas on an upper surface of said operation body, and also having a coupling section extending from a lower surface of said operation body and coupled to said operating axle, with said operating areas being equal in number to said plural switching contacts, and with each of said operating areas being positioned at a region that is between adjacent ones of said plural switching contacts such that a pressing force applied to a corresponding one of said operating areas results in said push structure contacting said adjacent ones of said plural switching contacts simultaneously, whereby any two of said adjacent ones of said plural switching contacts come into electrical contact via a corresponding pressing force.

16. The operation unit according to claim 15, wherein each of said operating areas is defined by a corresponding recessed portion on the upper surface of said operation body.

17. The operation unit according to claim 15, wherein said plural switching contacts are arranged in a circular pattern defining a fist diameter, and said operating areas are arranged in a circular pattern defining a second diameter, with the second diameter being generally equal to the first diameter such that said each of said operating areas is positioned circumferentially between said adjacent ones of said plural switching contacts.

18. The operation unit according to claim 15, wherein each of said plural multidirectional switches further includes a cover covering said case, with said cover having plural openings and said push structure comprising plural push member received within said plural openings, respectively.

19. The operation unit according to claim 18, wherein said plural push members are connected to one another via flexible arms so as to form a single body.

20. The operation unit according to claim 15, wherein said coupling section is coupled to said operating axle by being rotationally fixed to said operating axle.

21. The operation unit according to claim 20, wherein said sway body also has a bowl portion, with said sway body being swayingly supported by said support via said bowl portion.

22. The operation unit according to claim 21, wherein said support extends from a central portion of the bottom of said case, and said operating axle extends from a central portion of an upper surface of said bowl portion.

23. The operation unit according to claim 22, wherein each of said plural multidirectional switches further comprises a cover covering said case and having a central opening, with said coupling section extending from a central lower surface of said operation body and passing through said central opening.

24. The operation unit according to claim 23, wherein said push structure comprises plural push sections integral with said sway body and extending radially from an outer circumference of said bowl portion.

25. The operation unit according to claim 23, wherein each of said plural multidirectional switches further comprises plural push button switches on which are installed said plural switching contacts.

26. The operation unit according to claim 23, wherein said plural switching contacts comprise printed and cured conductive paste.

27. The operation unit according to claim 23, wherein said cover further has plural openings surrounding said central opening of said cover, and said push structure comprises plural push member received within said plural openings, respectively.

28. The operation unit according to claim 27, wherein said plural push member are connected to one another via flexible arms so as to form a single body.

* * * * *